US009802290B2

(12) United States Patent
Jones

(10) Patent No.: US 9,802,290 B2
(45) Date of Patent: Oct. 31, 2017

(54) RESURFACING BALL CONTAINER

(71) Applicant: Evan Jones, Roswell, GA (US)

(72) Inventor: Evan Jones, Roswell, GA (US)

( * ) Notice: Subject to any disclaimer, the term of this patent is extended or adjusted under 35 U.S.C. 154(b) by 188 days.

(21) Appl. No.: 13/838,675

(22) Filed: Mar. 15, 2013

(65) Prior Publication Data

US 2014/0273769 A1 Sep. 18, 2014
US 2017/0225286 A9 Aug. 10, 2017

Related U.S. Application Data

(60) Provisional application No. 61/678,444, filed on Aug. 1, 2012.

(51) Int. Cl.
*B24B 31/073* (2006.01)
*B24B 31/108* (2006.01)
*B24B 11/02* (2006.01)

(52) U.S. Cl.
CPC ..... *B24B 31/073* (2013.01); *B24B 11/02* (2013.01); *B24B 31/108* (2013.01)

(58) Field of Classification Search
CPC ... A63B 2047/046; A63B 47/04; B24B 11/02; A47L 25/00
USPC ..... 451/50, 327
See application file for complete search history.

(56) References Cited

U.S. PATENT DOCUMENTS

| | | | | |
|---|---|---|---|---|
| 3,654,655 | A * | 4/1972 | Mitnick | 15/21.2 |
| 4,216,629 | A * | 8/1980 | DeGaeta | 451/50 |
| 5,546,629 | A * | 8/1996 | Shim | 15/302 |
| 6,213,854 | B1 * | 4/2001 | Gegenheimer | 451/326 |
| 6,643,881 | B1 * | 11/2003 | Shim | 15/21.2 |
| 6,733,374 | B2 * | 5/2004 | Gegenheimer et al. | 451/326 |
| 6,821,191 | B2 * | 11/2004 | Lim et al. | 451/50 |
| 6,887,135 | B2 * | 5/2005 | Lim et al. | 451/50 |
| 8,550,882 | B2 * | 10/2013 | Shim | 451/103 |
| 2004/0082280 | A1 * | 4/2004 | Lim | A63B 47/04 451/50 |
| 2006/0260075 | A1 * | 11/2006 | Sun | 15/21.2 |
| 2012/0137456 | A1 * | 6/2012 | Welsh et al. | 15/97.1 |
| 2014/0038495 | A1 * | 2/2014 | McNall et al. | 451/50 |

FOREIGN PATENT DOCUMENTS

| | | | | |
|---|---|---|---|---|
| GB | 387081 | * | 2/1933 | A47J 17/18 |

* cited by examiner

*Primary Examiner* — Monica Carter
*Assistant Examiner* — Lauren Beronja
(74) *Attorney, Agent, or Firm* — Intellectual Property Center, LLC; Arthur Shaffer

(57) ABSTRACT

The present invention provides a resurfacing ball container for repeated removal of dirty, used or damaged surfaces from a plurality of India rubber type bounce balls. The resurfacing ball container also allows for easy transport and storage of balls during periods of non-use. The resurfacing ball container includes a cylinder with a lid and an abrasive surface rotating within the cylinder for resurfacing the contained balls.

14 Claims, 4 Drawing Sheets

RESURFACING BALL CONTAINER

FIELD OF THE INVENTION

The present invention is generally directed towards a container for balls and more specifically to a ball cleaning container presenting an abrasive element to clean lacrosse balls.

BACKGROUND OF THE INVENTION

India rubber balls, also known as lacrosse balls, become worn, damaged or dirty with use or with time, since these balls are played with outside on grass or dirt fields where the surface of the ball may come into contact with the field or another player's stick. These worn, damaged or dirty balls can create drag or unexpected reactions from the ball during competition or practice, resulting in less than ideal conditions.

The unevenly worn, scratched or dirty ball makes it difficult for an individual, player or team to use his/her/their skills due to its unpredictable and irregular spin or flight. In addition, players require a certain "grip," which worn, damaged or dirty balls do not have. Over time, the grip wears off and the balls become slippery or "greasy," making them difficult to play with and, therefore, frustrating players. An individual, player, or team has less control of a slippery ball and, therefore, is less effective in shooting and passing. Consequently, the worn or damaged ball reduces the joy in the game and exerts a great adverse influence on the score of the game. Therefore, in order to remove the damaged, worn or dirty ball and to restore the correct texture to the outer surface of the ball, the surface should be periodically replaced.

With the number of balls required during practice and games, replacing the balls every time they get dirty, worn or damaged can be expensive for many individuals, players or teams. Some individuals currently address this issue by scratching balls on the pavement or roughening the ball outer surface with a loose sheet of sandpaper, one at a time.

Currently, most individuals, players or teams purchase new balls to overcome these concerns. However, resurfacing the outer surface of a ball can restore the worn, damaged or dirty ball to a like-new condition with proper grip, allowing an individual, player or team to maximize his/her/their playing potential.

SUMMARY OF THE INVENTION

An embodiment of the invention includes a container with the resealable lid for easy storage and transport of the balls, the container including an abrasive surface which is positioned for contact with the plurality of ball outer surfaces to generate agitation and apply resurfacing action to the balls to resurface the balls.

In one embodiment, the abrasive surface is a spinning disc which rotates according to a tool in communication with a rotational member.

In one embodiment, the abrasive surface is an abrasive sidewall associated with a sidewall on the container.

Various objects and advantages of the present invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
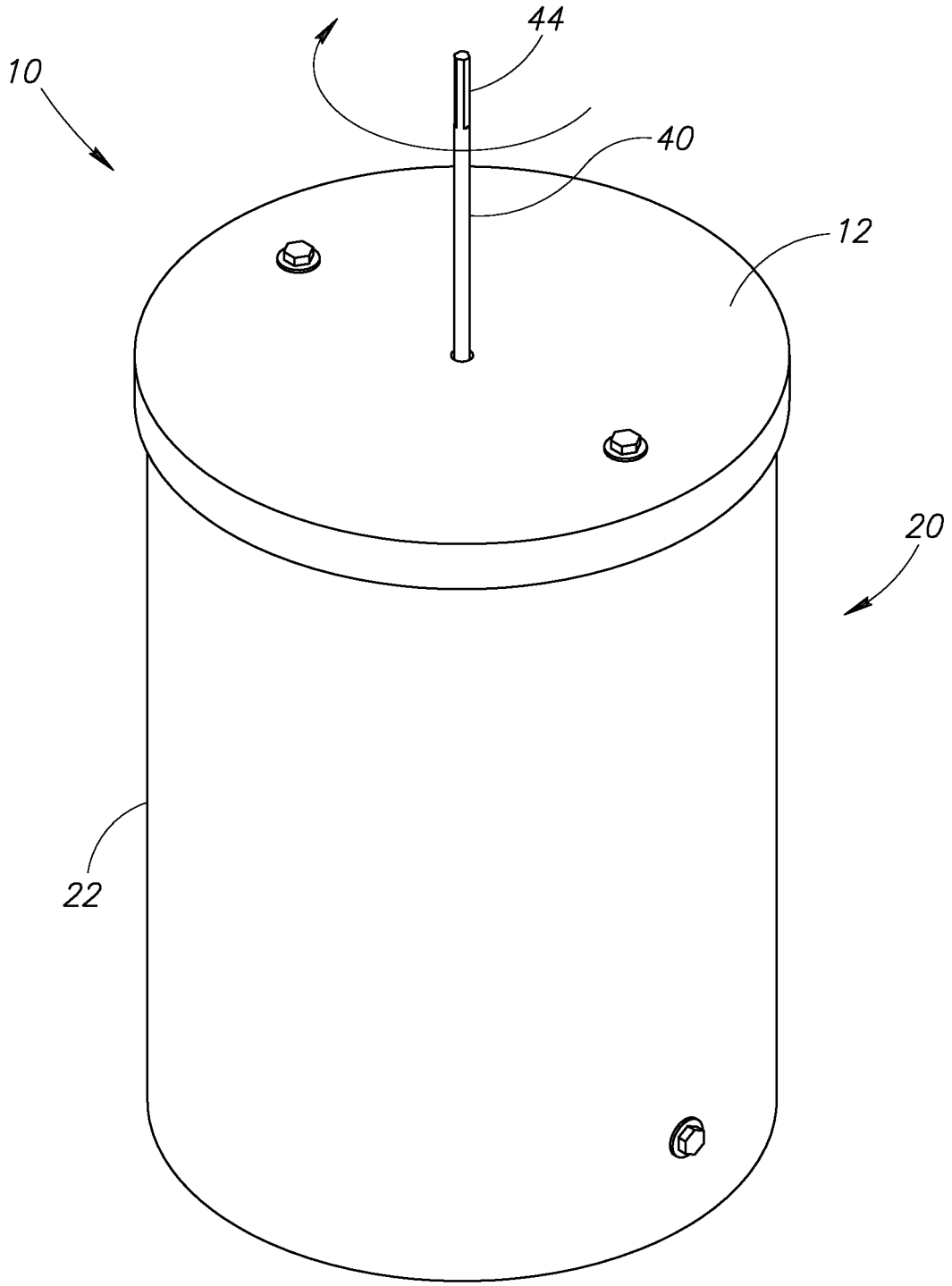
FIG. 1 is an isometric view of an embodiment of a resurfacing ball container for use in the present invention.
Figure 2A:
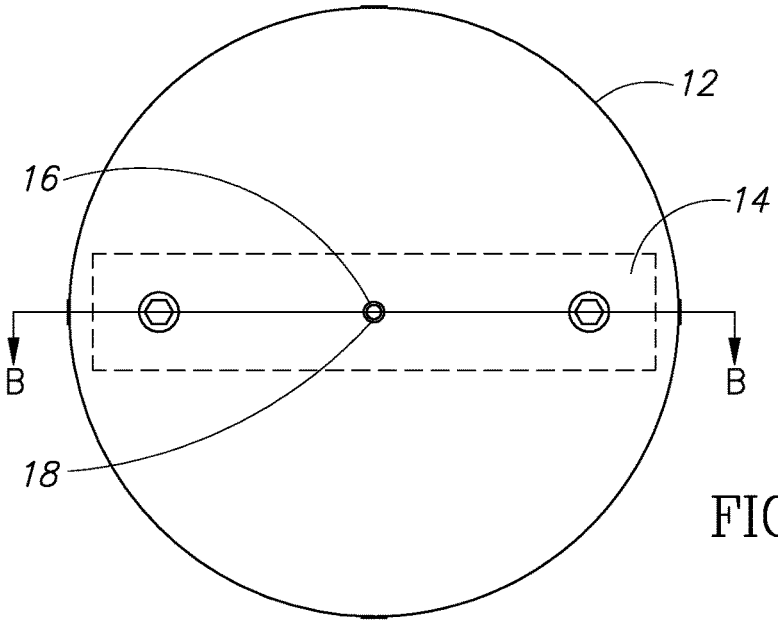
FIG. 2A is a detailed top view of an embodiment of a lid in connection with the resurfacing ball container depicted in FIG. 1.
Figure 2B:
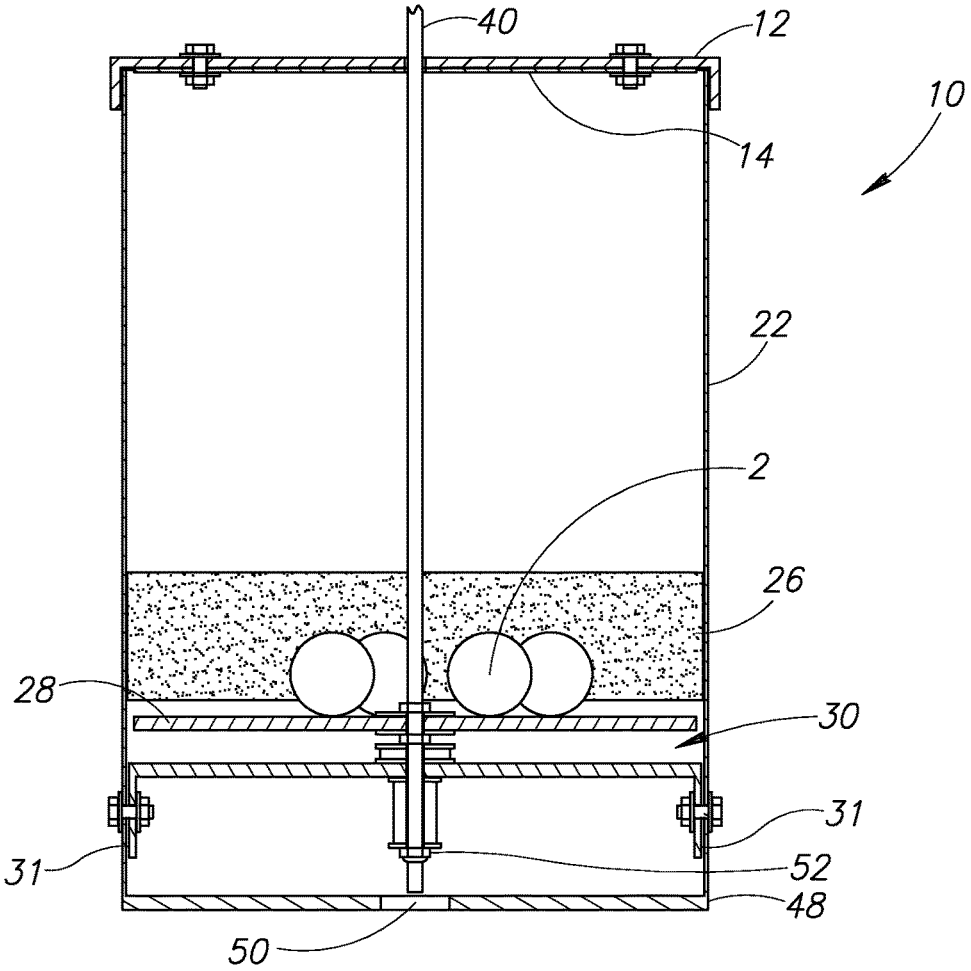
FIG. 2B is a cross section view of an embodiment of the resurfacing ball container of FIG. 1.

As illustrated in FIG. 1 and FIG. 2B, a resurfacing ball container 10 is presented with a container 20, a lid 12 and a rotational member 40 extending therebetween. Although other containers may be utilized, in FIG. 1, the illustrated container 20 is generally cylindrical defined by a circular bottom 48 with a sidewall 22 extending along the perimeter and upwardly therefrom. The rotational member 40 includes a shaped end 44 opposite a threaded end 42, the shaped end 44 being adapted for rotation by a power source (not shown), such as but not limited to a power tool, an electronic driver or a hand drill. Alternatively, the rotational member 40 may be manually rotated. In the illustration of FIG. 1 the shaped end 44 is adapted for rotational movement during receipt by a rotating drill chuck (not shown). The shaped end 44 extends outwardly from the container 20 through the lid 12. The threaded end 42 extends towards the circular bottom 48 and is generally accessible through a passage 50 located along the circular bottom 48.

FIG. 2A shows an upper guide 14 located in association with the lid 12, the upper guide 14 is illustrated as being mechanically fastened to the underside of the lid 12. The upper guide 14 further includes a guide receiver 16 in communication with a complementary upper aperture 18 associated with the lid 12 for receipt of the rotational member 40. The upper guide receiver 16 has sufficient diameter to receive the rotational member 40 which has a diameter of less than ⅜" in one embodiment. The upper guide receiver 16 is in communication with a lower guide receiver 32 and is adapted for receipt and vertical alignment of the rotational member 40.

FIG. 2B shows the resurfacing ball container 10 in receipt of a plurality of balls 2 each having an outer surface, the rotational member 40 extending vertically from the lid 12 towards the bottom 48. The upper guide 14 operates in cooperation with a lower guide 30 to align the rotational member 40 with the passage 50. In addition, the resurfacing ball container 10 may include a plurality of abrasive layers including, but not limited to, an abrasive sidewall 26 and an abrasive disk 28, which work in cooperation with each other for abrading the outer ball surfaces.

As illustrated, the upper guide 14 is located on the underside of the lid 12 and is of sufficient dimension and shape to present the upper guide receiver 16 for alignment of the rotational member 40. Alternatively, the upper guide 14 may be located above the lid or as otherwise desired, including integrated into the lid 12 itself. In addition, the upper guide 14 includes fasteners which limit unwanted rotation of the upper guide 14 during operation. Alternatively, the upper guide 14 may have sufficient size and shape for securing to the interior sidewall 22 of the cylinder 20.

During operation, the resurfacing ball container 10 abrades the outer ball surface without changing the operable shape or functional size of the ball so the ball 2 is still within the appropriate dimensions for play. In addition, the container 20 allows for receipt of multiple balls 2, which can be sealed with the lid 12 so that multiple balls 2 can be simultaneously resurfaced. Generally, the rotational member 40 is vertically centered within the container 20 by the upper guide 14 and lower guide 30, the rotational member 40 being in communication with the power source at the shaped end 44 of the rotational member 40. The abrasive disc 28 in contact with the balls 2 rotates with the rotational member 40, providing distributed and continuous motion to the outer ball surface. As the abrasive disc 28 rotates, kinetic energy is transferred to the balls 2, causing the balls 2 to become excited and bounce upwardly, off the rotating disc 28, the abrasive layer 26 and other surrounding balls 2. The movement of the balls 2 along the abrasive surfaces presents a fresh outer ball surface with a minimum of time and effort.

The container 20 with the resealable lid 12 and optional handle (not shown) allows for easy storage and transport of the balls 2. Additionally, the container 20 may be used remotely through the use of cordless, battery operated power sources including, but not limited to cordless drills. During operation, the container 20 receives the lid 12 which, when sealed, limits potential injuries and maintains the balls 2 in proximity with the abrasive surfaces, including the rotating abrasive disc 28. Through operation, the rotating abrasive disc 28 provides contact with the plurality of ball outer surfaces, thereby returning them to an acceptable playing condition. A second abrasive surface, an abrasive strip or layer 26 may be provided along the interior of the cylinder sidewall 22 to generate agitation and apply resurfacing action to the balls 2, the abrasive sidewall surface 26 adding to the agitation action to resurface the outer ball surfaces. The illustrated abrasive surfaces include the abrasive disc 28 and the abrasive sidewall 26. While the resurfacing ball container 10 does not necessarily require both, when both are present, they are configured to work complementary with each other to expedite and promote resurfacing of the ball 2 in comparison to a single abrasive surface.

In operation, the cylinder 20 receives the rotational member 40 which is aligned with the upper and lower guides 14, 30. The abrasive disc 28 is located along a shaft 41 of the rotational member 40 between the shaped end 44 and the threaded end 42, the rotational member 40 being operationally adapted for rotation of the abrasive disc 28 in communication with the power source (not shown). The plurality of balls 2 are placed within the cylinder 20 for contact with the abrasive disc 28, which is located between the upper and lower guides 14, 30. After receipt by the container 20 of the balls 2 and before operation of the power source, the lid 12 is sealed onto the container 20. After applying the power source (not shown) to the shaped end 44, the abrasive disc 28 is rotated, transferring kinetic energy from the power source to the balls 2 through the rotational member 40 and abrasive disc 28. As the balls 2 receive the kinetic energy from the power source, the balls 2 become agitated and move from the abrasive disc 28 up and down, bouncing off each other and along the cylinder sidewall 22, traversing the abrasive disc 28 while each dirty, worn or damaged outer ball surface is reshaped and resurfaced to an acceptable playing condition.

The abrasive disc 28 may be further mounted on the rotating member by using a radial fastener 36 (also shown in FIG. 3) above and below the abrasive disc 28, the fasteners working together and, in one embodiment, in combination with a plurality of circular members 56, clamp the abrasive disc 28 for rotation by the rotating member 40. The lower guide 30 is further illustrated with a pair of downwardly depending sidewall mounts 31 to help secure the guide 30 within the container 20, the sidewall mounts 31 include fastener receivers, mechanical or otherwise for securing the lower guide 30 within the container 20 and to prevent any undesired rotation of the lower guide 30 by the rotating member 40. Although the sidewall mounts are shown with only one fastener receiver, a plurality may be provided for receipt of a plurality of fasteners to limit undesired movement as the lower guide 30 may experience rotation during rotation of the rotational member 40. Therefore, each sidewall mount 31 may utilize either a single fastener or a plurality of fasteners or adhesives to address any undesired rotational forces. Alternatively, the sidewall mounts 31 may be shaped for fastening to the bottom 48 or elsewhere to prevent undesired rotation of the lower guide 30.

An adjustment member 52 is further illustrated in FIG. 2B. The adjustment member 52 is located on the threaded end 42 of the rotational member 40 and vertically secures the rotational member 40 in relation to the lower guide 30 at the lower guide receiver 32. The adjustment member 52 allows the rotational member 40 to rotate during operation while limiting unwanted vertical movement of the shaft 41 when not in use. For example, when the lid 12 in receipt of the upper guide 14 is removed from the container 20, the rotatable member 40 may experience undesired vertical movement. Without the adjustment member 52, the rotatable member 40 may travel out of vertical alignment. However, with the adjustment member in place, the threaded end 42 of the rotational member 40 remains supported by the lower guide 30 for quick and easy reassembly.

The passage 50 allows for adjustment of the adjustment member 52, the passage 50 being located approximately near the center of the bottom 48 and providing access to the adjustment member 52 centrally located thereat. The passage 50 allows an operator to adjust the adjustment member 52 by hand or with, for example, a tool such as a socket or other tools for positioning the adjustment member 52 along the threaded end 42 of the rotational member 40. Preferably, the proper adjustment allows for rotation of the rotational member while limiting unnecessary vertical movement thereof.

Figure 3:
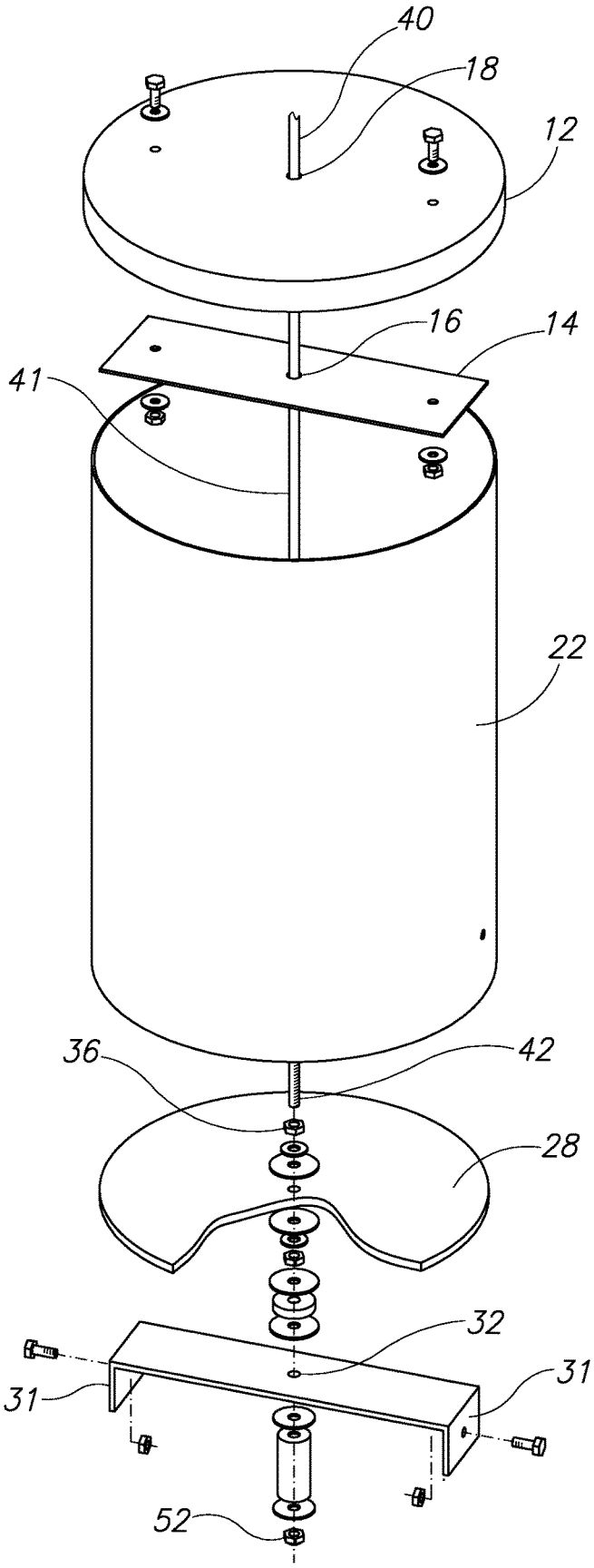
FIG. 3 is a partially exploded upper view of the ball resurfacing container of FIG. 1.

As depicted in FIG. 3, the resurfacing ball container 10 may be assembled by providing the cylinder 20 having the sidewall 22 extending upwardly from the bottom 48 and the passage 50 located within the bottom 48 and a resealable lid 12 adapted for closure of the cylinder 20 opposite the bottom 48. The abrasive layer 26 is secured to the interior of the sidewall 22. The rotational member 40 presenting the threaded end 42 separated from the shaped end 44 by the shaft 41 is threaded through the abrasive disc 28 below the upper radial fastener 36 which is threaded above the abrasive disc 28 for securing and spacing the abrasive disc 28 along the threaded end 42. The threaded end 42 is inserted through the lower guide receiver 32 associated with the lower guide 30. A lower fastener 52 may be secured below the lower guide 30 presenting a firm fit between the abrasive disk 28 and the lower guide 30. The pair of depending sidewall mounts 31 associated with the lower guide 30 may be secured to opposite sides of the sidewall 22 wherein the threaded end 42 is directed towards the passage 50. The shaped end 44 is then threaded through the upper guide receiver 16 associate with the upper guide 14 and the lid 12 at the upper aperture 18, wherein the upper guide 14 is secured to the lid 12 with a pair of spaced apart fasteners which help limit undesired rotation.

Figure 4:
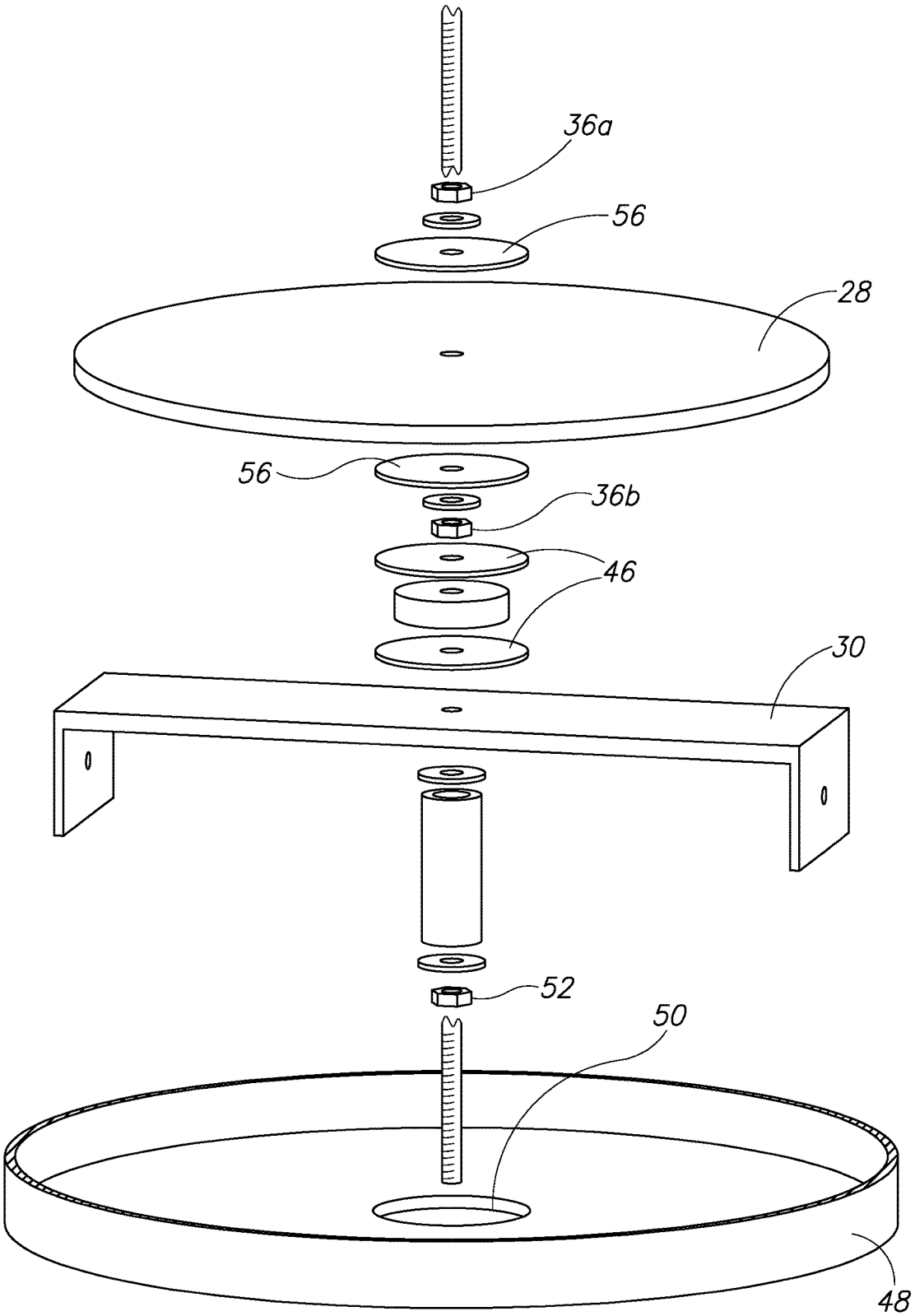
FIG. 4 is a partially exploded lower view of the ball resurfacing container of FIG. 1.

As further illustrated in FIG. 4, the plurality of circular members 56 may be used to provide for rotation of the abrasive disc 28. A first pair of circular members 56 may be used to compress the abrasive disc 28 with torsionally adjusted radial fasteners 36*a*, 36*b*. Optional, securing members 38 may be included to help secure the abrasive disc 28 during rotation. A friction reducing member 46 may be used to reduce rotational friction between the abrasive disc 28 and the lower guide 30. Alternatively, a lubricant layer may be positioned between a pair of circular members to reduce undesired friction and thereby providing greater rotational freedom and reduced rotational frictional during rotation. Reduction of friction may provide for greater rotational freedom of the abrasive disc 28 during operation of the rotating member 40 and for longer life of the rotational surfaces.

A spacer 54 may also be optionally provided between the lower guide 30 and the adjustment member 52. While the spacer is depicted as being cylindrical, other configurations are possible. The spacer is dimensioned to position the adjustment member within the passage 50 for easy access and occasional adjustment as desired by the user. The spacer may be fabricated from plastic, metal or wood materials and preferably will have an inner radius sufficiently greater than the shaft 41 to avoid engagement therewith while having an outer diameter to allow sufficient engagement with the shaft 41 by the adjustment member 52. A pair of circular members 56 are also provided each positioned on either side of spacer 54.

In an alternative embodiment, the cylinder 20 may be orientated horizontally with the rotational member 40 being operable and in communication with the lid 12 and the bottom 48 for rotation of the cylinder 20 as the balls 2 engage an alternative abrasive layer (not shown) extending substantially circumferentially and vertically along the interior of the sidewall 22 for removal of the dirty, worn or damaged outer ball surface.

It is to be understood that while certain forms of the present invention have been illustrated and described herein, it is not to be limited to the specific forms or arrangement of parts described and shown.

What is claimed and desired to be secured by Letters Patent:

1. A resurfacing ball container for resurfacing a plurality of used balls, the resurfacing ball container comprising:

a container with a single elongated rotational member extending continuously between a lid and a bottom, said rotational member having a shaped end with a plurality of straight segments, said shaped end opposite a threaded end, said shaped end adapted for rotation during receipt of said straight segments by a power tool, a lower guide spaced from said bottom for receipt of said threaded end therethrough, an open-ended passage centrally located at said bottom and providing access to said lower guide at said threaded end, said threaded end accessible through said bottom, an abrasive disc operably connected to said rotational member, and said rotational member rotating said abrasive disc for contact with one of the plurality of balls, wherein said abrasive disc presents a grip condition to the outer surface of at least one of said plurality of balls.

2. The resurfacing ball container of claim 1 wherein said abrasive disc transfers kinetic energy directly to an outer surface of said plurality of balls.

3. The resurfacing ball container of claim 1 further comprising an upper guide which receives said rotational member for alignment between said upper and lower guides.

4. The resurfacing ball container of claim 1 wherein said abrasive disc is substantially planar.

5. The resurfacing ball container of claim 1 wherein said abrasive disc is positioned along a shaft of the rotational member between said shaped end and said threaded end.

6. The resurfacing ball container of claim 1 further comprising a resealable lid for containing said plurality of balls.

7. The resurfacing ball container of claim 1 further comprising an abrasive sidewall.

8. The resurfacing ball container of claim 3 further comprising an upper guide receiver in communication with a lower guide receiver during rotation of said rotational member, said upper guide receiver positioned along said upper guide and said lower guide receiver positioned along said lower guide.

9. The resurfacing ball container of claim 8 wherein said upper guide receiver is vertically aligned with said lower guide receiver.

10. The passage of claim 3 wherein said upper guide receiver aligns said rotational member for rotational adjustment of an adjustment member through said open-ended passage.

11. The resurfacing ball container of claim 1 further comprising a pair of sidewall mounts extending from said lower guide and secured along a sidewall of said container.

12. The resurfacing ball container of claim 1 wherein an adjustment member vertically positions said rotational member within said container.

13. A resurfacing ball container for resurfacing a plurality of used balls, the resurfacing ball container comprising:

a container with a single rotational member extending continuously between a lid and a bottom with an open-ended passage therethrough, said rotational member having a shaped end with a plurality of straight segments adapted for rotation and a threaded end, an upper guide receiver in receipt of said shaped end and in communication with a lower guide receiver in receipt of said threaded end, wherein said upper guide receiver is positioned along an upper guide in vertical alignment with said lower guide receiver in position along said lower guide, said threaded end accessible through said open-ended passage in said bottom, and a rotational abrasive disc within said container for abrasion of said plurality of used balls.

14. A resurfacing ball container for resurfacing a plurality of used balls, the resurfacing ball container comprising:

a container with a single elongated rotational member extending continuously between a lid and a bottom with an open-ended passage therethrough, said rotational member having a shaped end with a plurality of straight segments, said shaped end opposite a threaded end, said shaped end adapted for rotation during receipt of said straight segments by a power tool, a lower guide spaced from said bottom for reciept of said threaded end therethrough, an adjustment member rotationally received by said threaded end securing said lower guide at a lower guide receiver, said open-ended passage being centrally located at said bottom and having sufficient size to provide spaced access to said lower guide at said threaded end whereby said open-ended passage provides rotational adjustment of said adjustment member through said bottom, said threaded end accessible through said bottom, and an abrasive disc operably connected to said rotation member wherein said plurality of used balls is abraded by said abrasive surface during rotation of the rotational member by said power tool.

* * * * *